US006973681B2

(12) United States Patent
Ayeni et al.

(10) Patent No.: US 6,973,681 B2
(45) Date of Patent: Dec. 13, 2005

(54) SPA JET MOUNTING ASSEMBLY AND METHOD OF INSTALLATION

(75) Inventors: Tokunbo Ayeni, Thousand Oaks, CA (US); Jack Buck, Simi Valley, CA (US); Mike Kulick, Thousand Oaks, CA (US)

(73) Assignee: Pentair Pool Products, MoorPark, CA (US)

( * ) Notice: Subject to any disclaimer, the term of this patent is extended or adjusted under 35 U.S.C. 154(b) by 0 days.

(21) Appl. No.: 10/077,671

(22) Filed: Feb. 15, 2002

(65) Prior Publication Data

US 2005/0050627 A1 Mar. 10, 2005

(51) Int. Cl.[7] ..... A61H 33/04
(52) U.S. Cl. ..... 4/541.6
(58) Field of Search ..... 4/541.1–541.6; 239/282, 428.5

(56) References Cited

U.S. PATENT DOCUMENTS 4,387,854 A * 6/1983 Dupont ..... 239/570
4,416,030 A * 11/1983 Reynoso ..... 4/541.6
5,657,496 A * 8/1997 Corb et al. ..... 4/541.6
5,809,648 A * 9/1998 Kurth et al. ..... 29/890.142
6,123,274 A * 9/2000 Perdreau et al. ..... 239/581.1
6,322,004 B1 * 11/2001 Perdreau et al. ..... 239/428.5
6,470,509 B1 * 10/2002 Ayeni ..... 4/541.6
6,904,626 B1 * 6/2005 Hester et al. ..... 4/541.6

* cited by examiner

*Primary Examiner*—Charles E. Phillips
(74) *Attorney, Agent, or Firm*—Hogan & Hartson, LLP

(57) ABSTRACT

A spa jet mounting assembly and method of installing and utilizing the same. An outer housing with an interior threaded chamber is connected to water and air pipes outside a bath. An inner housing, with an external threaded section is inserted through a passageway in the bath, and threadedly fastened within the threaded chamber of the outer housing. The bath surface and one or more gaskets are secured between flanges of the inner and outer housings. The inner housing includes one or more ports to drain water from the assembly. The opening in the bath can be sealed with an o-ring or by forming a seal via silicone injection. With the injection technique, silicone is injected into the inlet port of the outer housing, air is released through the outlet port of the outer housing, and a seal is formed around the passageway.

20 Claims, 14 Drawing Sheets

SPA JET MOUNTING ASSEMBLY AND METHOD OF INSTALLATION

FIELD OF THE INVENTION

The present invention relates generally to the field of spa jets, and, more particularly, to a mounting assembly for installing spa jets into a bath.

DESCRIPTION OF RELATED ART

Hydro-therapy is a useful form of physical therapy. In hydro-therapy, a bather rests in a body of water within a spa, while his or her anatomy is massaged by an aerated water stream flowing out of a spa jet. The aerated water stream is directed by a nozzle, through the body of water, and against the portion of the bather's anatomy where the massaging action is desired.

Spas are typically configured and designed for spa jets. For example, a customer can purchase a spa with pre-installed spa jets. Alternatively, the customer can purchase the spa and install the jets into spa sections designed to accommodate spa jets.

One example of a spa jet is described in U.S. Pat. No. 6,322,004, manufactured by Pentair Pool Products, Inc., Moorpark, Calif. This spa jet includes air and water inlet ports which receive and mix air and water and emit at least one jet of aerated water. For example, this example spa jet includes an enlarged head which mounts to an angularly displaceable nozzle that can be positioned at different angles relative to water flow, and then rotated at the different angles. For example, when the spa jet nozzle is aligned with the water flow path, a straight stream of aerated water exits the spa jet. However, if the nozzle is positioned at an angle, i.e., is not aligned with the water flow path, then the aerated stream of water is diverted at an angle relative to the water flow path. The nozzle and the corresponding point of contact of the aerated water stream then rotate due to the rotational force of the pressurized aerated water stream. The rotation speed of the nozzle increases as the angle between the nozzle and the water flow path increases.

Instead of using a separate spa, spa jets can also be inserted into a bath. Installing spa jets into a bath is beneficial because the bather is not required to purchase a separate spa, thereby saving money and space.

Referring to FIG. 1, a bath 10 can be configured with spa jets 11 installed through holes or openings 12 in the side, front, or back of the bath 10.

Referring to FIG. 2, a yoke 13 or system of air and water pipes, surrounds the bath 10. Interfaces 20 are coupled to the yoke 13 via air and water couplers 30, 32. With this basic system, spa jets can be retrofitted into old baths, or installed into new baths. For example, if a new housing development or subdivision is being built, a series of baths can have spa jets installed as part of the home building process. Spa jets can be installed in one bath, then the next bath, and so on, for all of the baths in the development.

The first step in the conventional installation process is to form the opening 12 through the bath 10. The yoke 13 or assembly of air and water pipes is installed around the bath 10. One or more interfaces 20 are connected within the yoke 13 and aligned with respective openings 12. In a housing development, for example, each yoke 13 surrounding each bath 10 may be supported bricks 14 or other supports since the house is under construction. Each spa jet 11 is then secured through the opening 12 and into the interface 20 coupled to the yoke 13 with a conventional mounting assembly illustrated in FIGS. 3–6.

Referring to FIG. 3, the interface 20 serves as a link between air and water pipes of the yoke and a spa jet (not shown). The interface 20 includes an air coupler 30 which taps into an air supply line, and a water coupler 32 which taps into a water supply line. A two part ring coupler, formed by an inner ring 40 and an outer ring 50, is threadedly secured to via a threaded interior 42 of the inner ring 40 and a threaded outer diameter 22 of the interface 20. A protective ring, seal, or gasket 60 seals an outer face 59 of the outer ring 50 to the outside surface 14 of the bath 10. A flange 70 is threadedly secured to the interface 20 against the inside bath surface 16.

FIGS. 4A–C, illustrate the steps involved in installing the conventional mounting assembly in FIG. 3. First, in FIG. 4A the components positioned outside the bath 10 are roughly aligned along an axis such that a threaded end 22 of the interface 20 slides through the opening 12. At this point, the inner and outer ring components 40, 50, and an o-ring seal 60 are unconnected as illustrated by gaps or spaces between the components.

Next, as illustrated in FIG. 4B, in order to loosely secure the assembly, the flange 70 is partially threadedly secured to the threaded end 22 of the interface 20. This is further illustrated by the components being dawn closer together, but still unconnected.

Then, in FIG. 4C, the mounting components are tightened, and final alignments and adjustments are performed. More specifically, referring back to FIG. 3, the threaded end 22 of the interface 20 is coupled to a threaded interior 42 of the inner ring 40. The inner ring 40 includes a guide 44, an inlet port 46 and an outlet port 48.

The outer ring 50 is attached to and surrounds the inner ring 40. The outer ring 50 includes a guide path 52 which receives the guide 44 of the inner ring 40. The outer ring 50 also includes retaining ridges 54 which secure the inner ring 40 therein. When secured, the guide 44 of the inner ring 40 rests within the guide path 52. The inner ring 40 can slide above the outer ring 50 to a certain degree while being retained by ridges 54. However, if the inner ring 40 slides beyond the retaining ability of the ridges 54, the inner ring 40 is released from the outer ring 50.

When the inner and outer rings 40, 50 are properly aligned, the inlet port 56 of the outer ring 50 is aligned with the inlet port 46 of the inner ring 40. Similarly, the outlet port 58 of the outer ring 50 is aligned with the outlet port 48 of the inner ring 40. A sealant can then be injected into the aligned inlet ports 46, 56. Air displaced by the formation of a seal is released through aligned outlet ports 48, 58, and eventually a protective ring or gasket 60 is formed between the outer face 59 of the outer ring 50 and the outside 14 of the bath 10 around the opening 12. Alternatively, a separate gasket or o-ring 60 can be positioned and secured between the outer face 59 of the outer ring 50 and the outside surface 14 of the bath 10. When the components are assembled, the properly aligned o-ring 60 is secured between the outer ring 50 and the outside surface 14 around the opening 12.

The mounting assembly components located outside the bath 10 are further illustrated in FIG. 5. One set of phantom lines illustrates water and air pipes of the yoke 13 coupled to an interface 20 via air and water couplers 30, 32. A second set of phantom lines illustrates an installer's hand positioning and adjusting mounting components within a confined area outside the bath 10.

As illustrated in FIG. 5, an installer may have to position or adjust various components, behind or outside the bath.

For example, the installer holds the interface 20 and inner ring 40 while attaching the inner ring 40 to the interface 20, aligns the inner and outer rings 40, 50, holds a protective o-ring 60 in position, injects a sealant into the inlet ports 46, 56 of the aligned rings 40, 50, or holds one or more components flat against the back of the tub 10 to maintain the position of the protective seal 60. These adjustments are more complicated if the air and water pipes are not properly supported or if the components are not visible behind the bath.

Referring to FIG. 6, when the flange 70 is finally secured to the threaded surface of the interface 20, the bath 10 wall is secured between a back face of the flange 70 and the front bath surface 16. The protective ring 60 is secured between the outer ring 50 and the outside bath surface 14. A spa jet can then be inserted through the flange 70, and into the interface 20, secured by locking ridges or threads 72 with in the flange 70.

In use, air and water are provided from the air and water pipes, through ports in the interface 20, and to the spa jet which produces an aerated water stream. However, water can collect in the mounting assembly, and the flange 70 includes drainage port 76 to drain excess water.

While conventional mounting assemblies serve the basic purpose of installing spa jets into a bath, there are a number of aspects of present assemblies that can be improved.

First, the overall number of components can be reduced.

Second, the number of adjustments can be reduced.

Third, the number of component adjustments behind or outside the bath can be reduced. These improvements simplify the installation process and reduce the number of adjustments in limited spaces outside the bath.

Fourth, the seal quality can be improved to reduce water leakage through the opening in the bath. One source of poor seal quality is the installer working within confined spaces. For example, if the inner and outer rings are not properly aligned while sealant is being injected into the misaligned parts, gaps or weaker sections of the protective ring can be formed due to inconsistent sealant flow, resulting in leaks. Additionally, if the installer can not properly align and maintain the o-ring between the outer ring and the outside bath surface, gaps within the seal can be formed.

These seal problems are amplified by the rough, uneven outside surface of the bath which can permit water to leak between the protective ring and the rough abutting bath surface. Moreover, these problems are amplified when the spa jet is installed in a bath wall having a curved, warped, or non-planar surface. Thus, providing for more effective seals would improve conventional spa jet mounting systems.

Fifth, the quantity of stagnant water collected within a spa jet assembly can be reduced. Stagnant water is a potential source of bacteria growth and other health hazards. Government regulations dictate allowable levels of water that can be retained in spa jet assemblies to safeguard against such hazards.

Referring to FIG. 6, conventional mounting assemblies typically utilize a single drainage port to remove water from a spa assembly. While a single drainage port may satisfy regulations, improving the drainage capabilities of the mounting assembly can further reduce health risks associated with water collected in spa jet components.

Accordingly, it is an object of the present invention to provide a spa jet mounting assembly in which inner and outer housings provide for simplified installation and sealing as well as increased drainage capabilities.

BRIEF DESCRIPTION OF THE DRAWINGS

Other features and advantages of the preset invention will be set forth in part in the description which follows and in the accompanying drawings, wherein.

SUMMARY OF THE INVENTION

The present invention provides a spa jet mounting assembly and method of installing a spa jet assembly utilizing the mounting assembly.

According to the present invention, A housing located outside the bath is connected to a water pipe and an air pipe. The housing includes an air port for receiving air from the air pipe and a water port for receiving water from the water pipe. An inner housing is inserted from inside the bath through the opening and into the outer housing. The inner housing includes air and water ports in communication with the air and water ports in the outer housing. Thus, water is provided from the water pipe through the water port of said outer housing and to the water inlet port of said inner housing, and air is provided from the air pipe through the air port of said outer housing and to the air inlet port of said inner housing. The inner housing is secured within the outer housing, and a spa jet is secured within the inner housing. Once inserted, inlet and outlet ports of the spa jet coincide with inlet and outlet ports of the inner housing which are in communication with air and water pipes through air and water ports in the outer housing and connecting air and water couplers.

In further accordance with the present invention, the outer housing includes a cylindrical receiving chamber. The inner housing is threadedly engaged within the cylindrical receiving member.

Also in accordance with the present invention, the inner housing is rotatably adjustable from the inside of the bath.

In further accordance with the present invention, the inner housing includes one or more drain ports extending around a base of said inner housing to drain water from the mounting assembly.

In still further accordance with the present invention, a seal is positioned around the opening between a housing and a bath surface.

In yet further accordance with the present invention, the outer housing includes a flange which extends around the opening in the bath and inlet and outlet ports positioned on opposite ends of the flange. A sealant such as silicone is injected into the inlet port, and displaced air is released through the outlet port, thereby forming a seal around the flange and around the opening in the bath.

DETAILED DESCRIPTION

Figure 1:
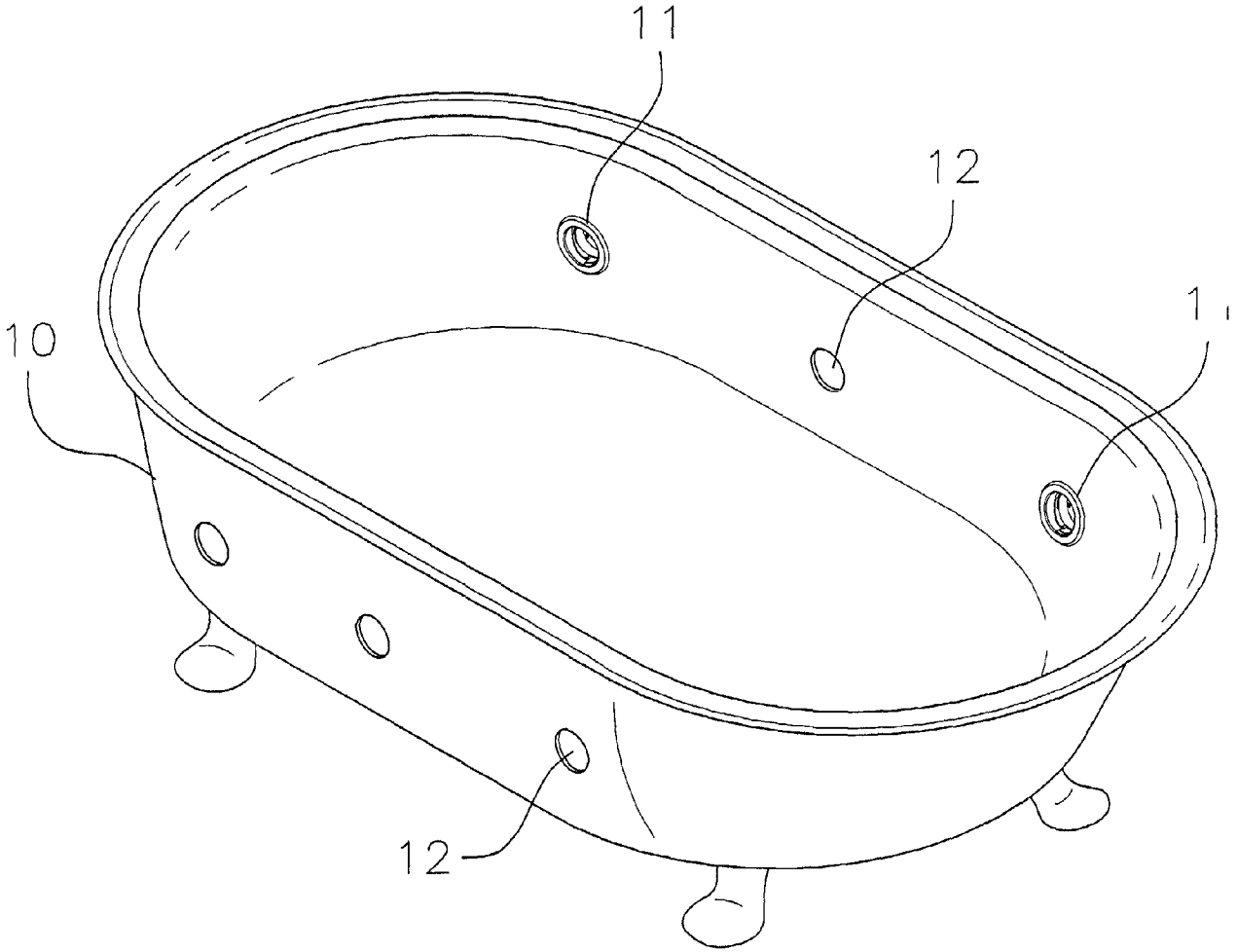
FIG. 1 is a perspective view of a bath with spa jets installed in passageways formed in the bath.
Figure 2:
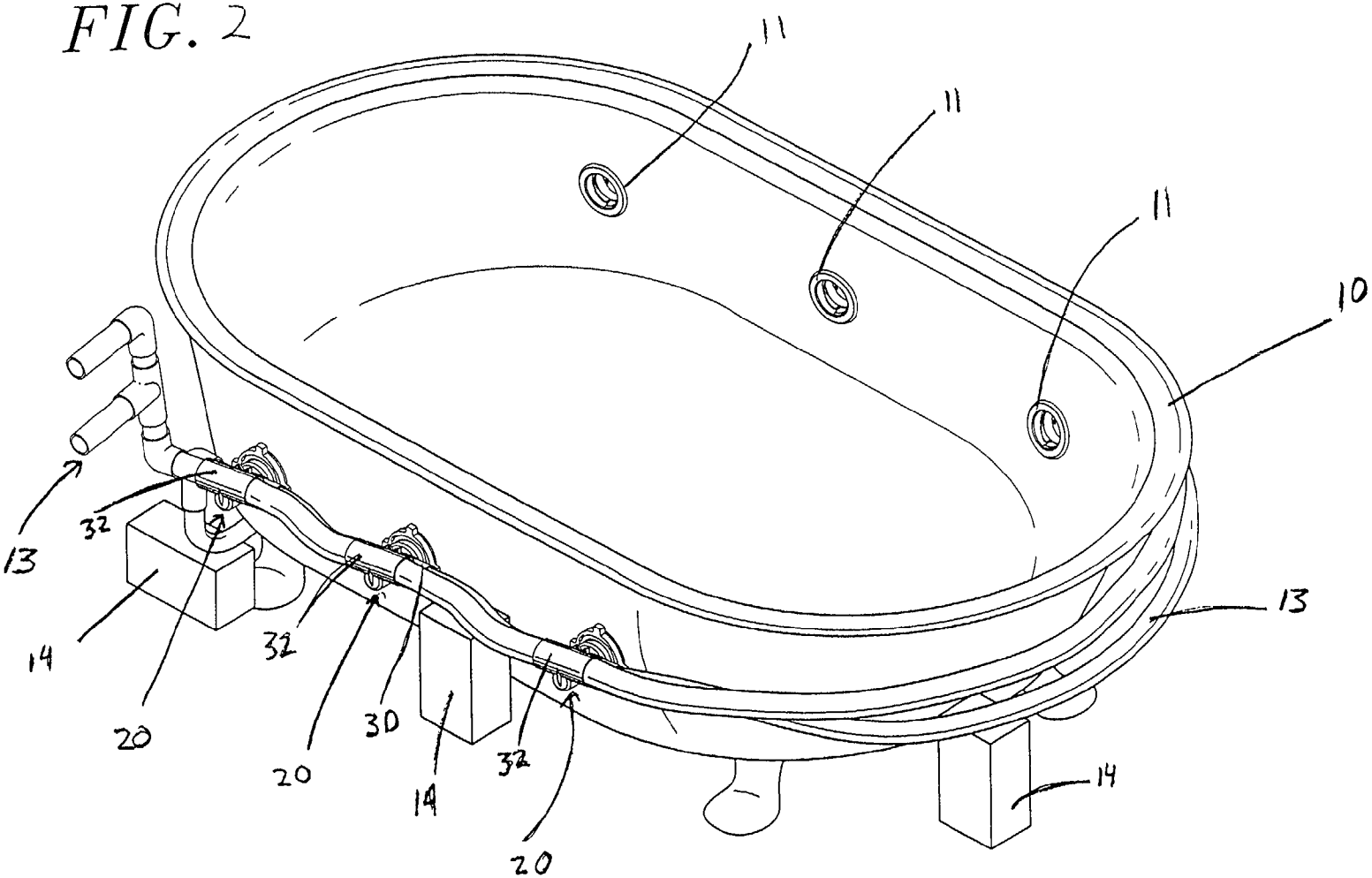
FIG. 2 is a perspective view of air and water pipes surrounding the bath.
Figure 3:
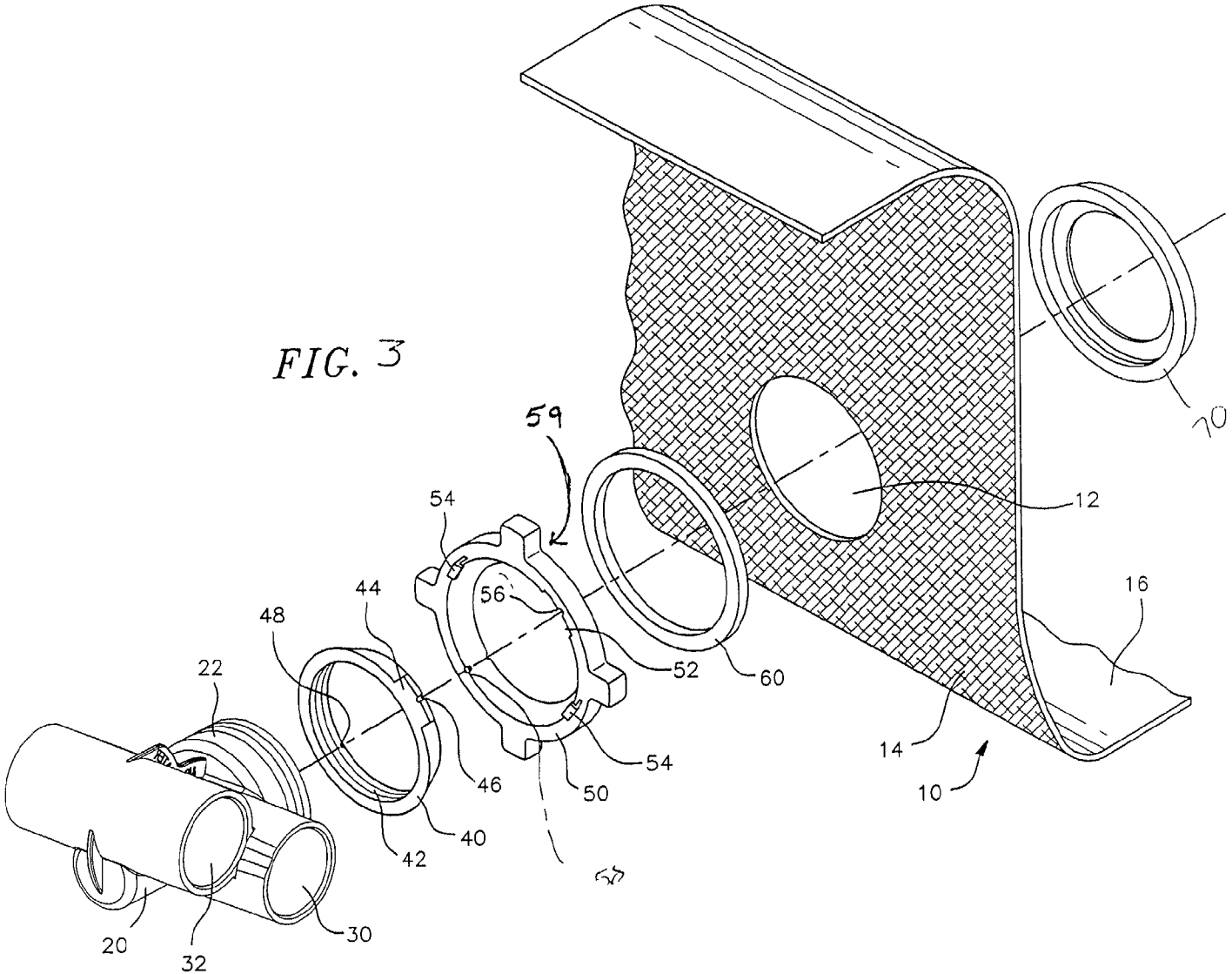
FIG. 3 is a perspective exploded view of unassembled components of a conventional spa jet mounting system.
Figure 4A:
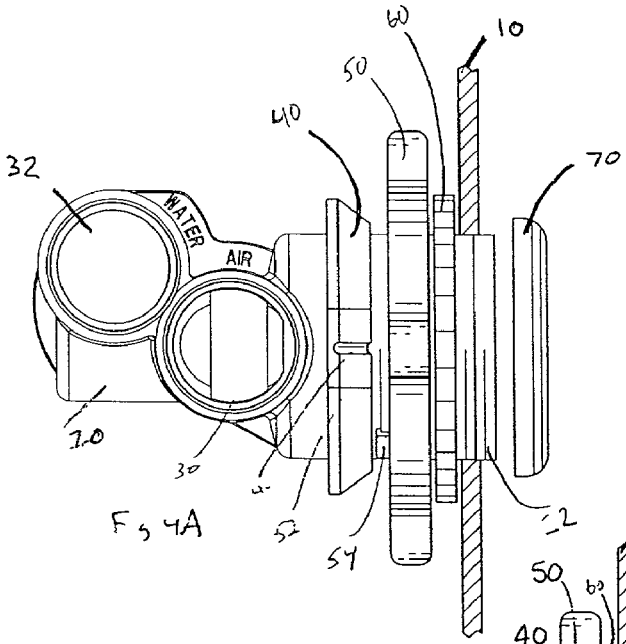
FIGS. 4A–C are perspective views illustrating the steps of installing the conventional mounting system.
Figure 4B:
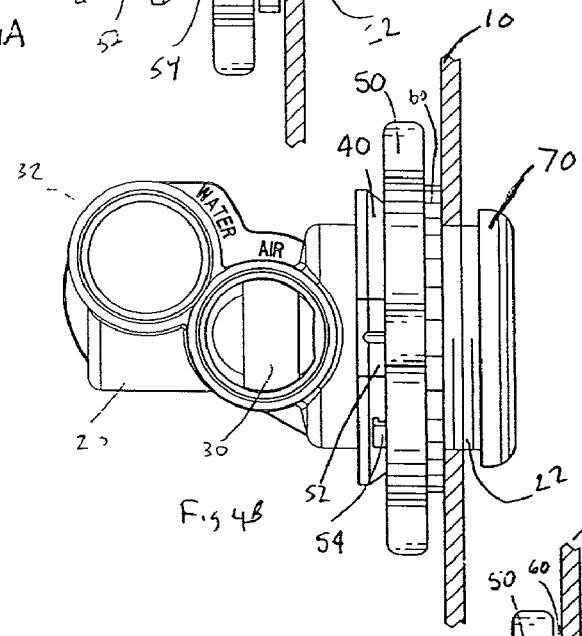
Figure 4C:
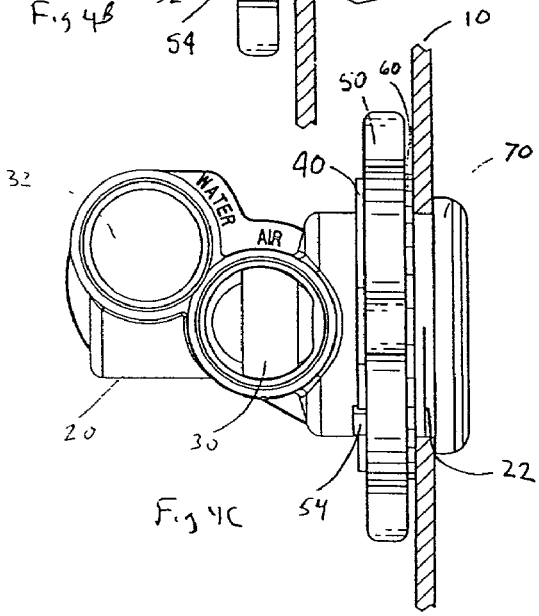
Figure 5:
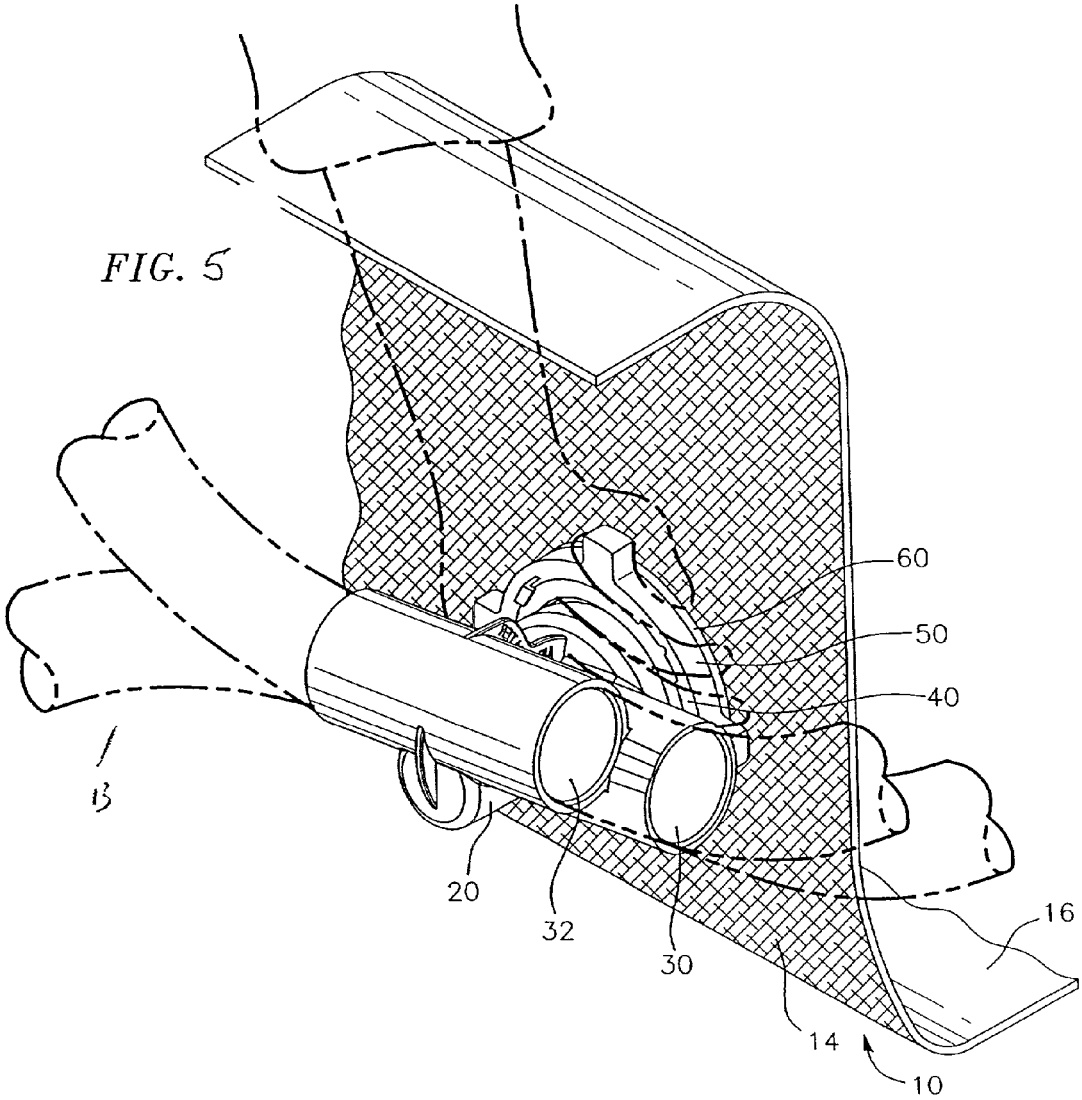
FIG. 5 is a perspective view of a conventional spa jet mounting system assembled outside the bath.
Figure 6:
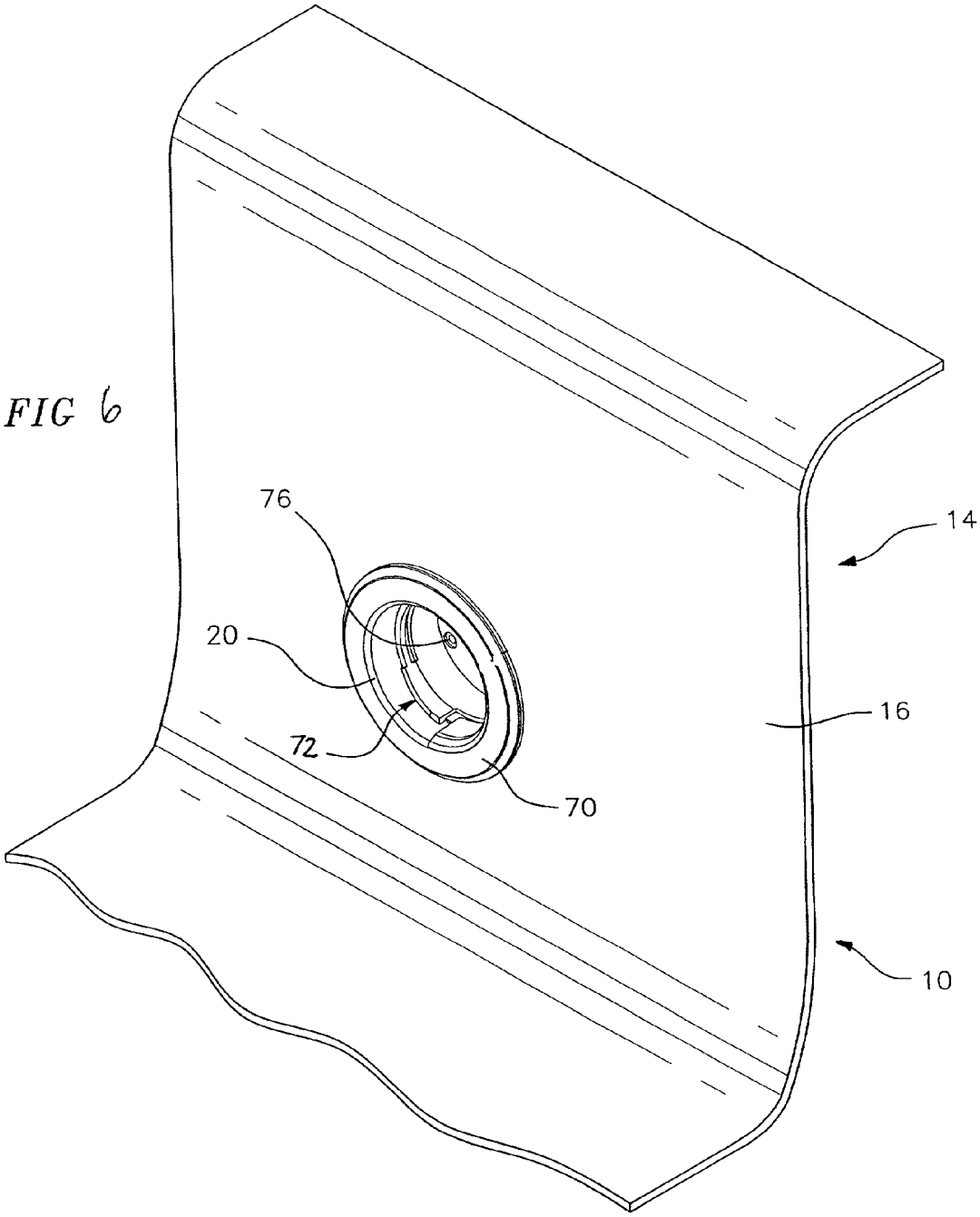
FIG. 6 is a front perspective view of the conventional spa jet mounting system inside the bath.
Figure 7A:
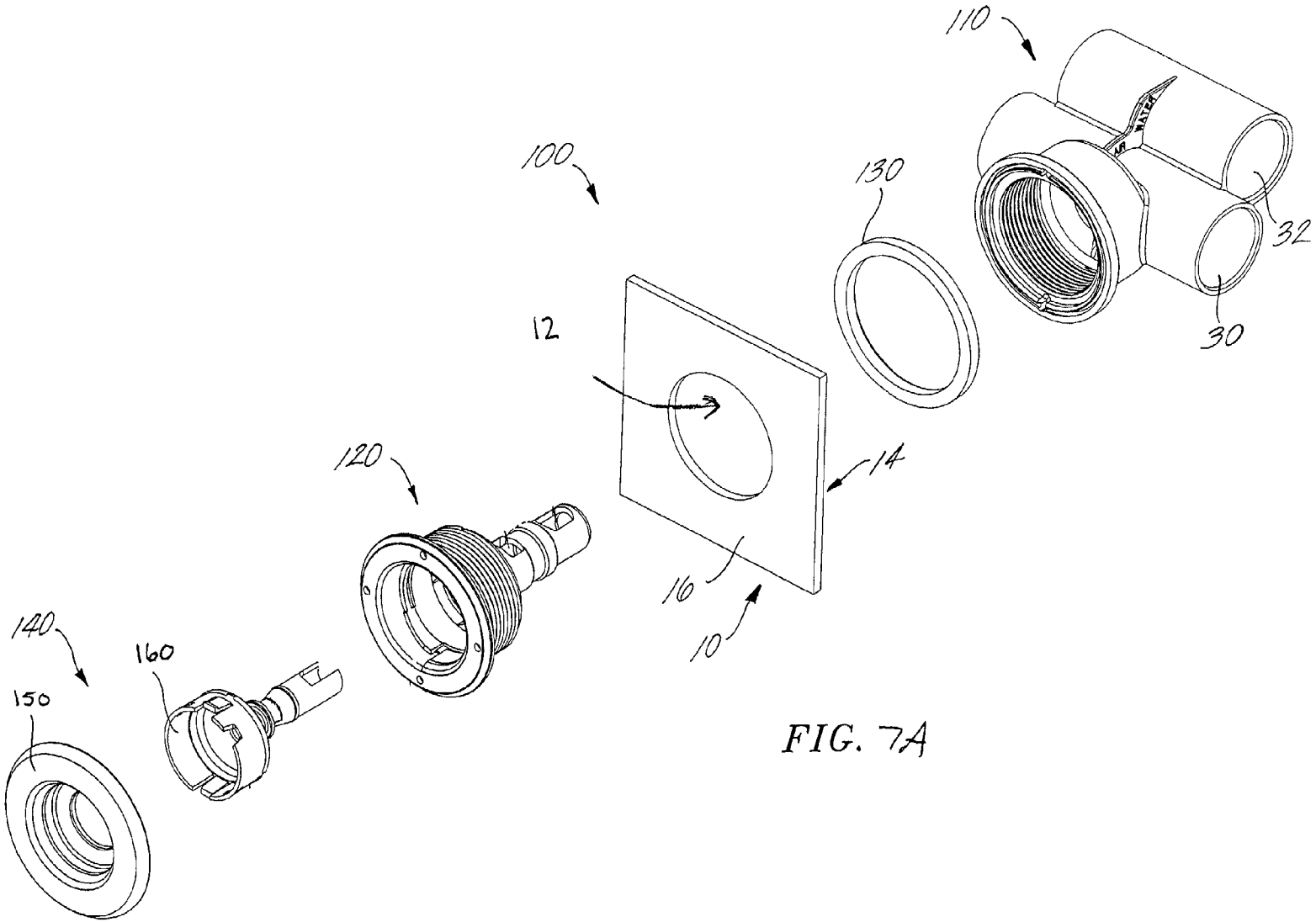
FIGS. 7A–B are front and rear perspective views of the components of a spa jet mounting assembly according to the present invention.
Figure 7B:
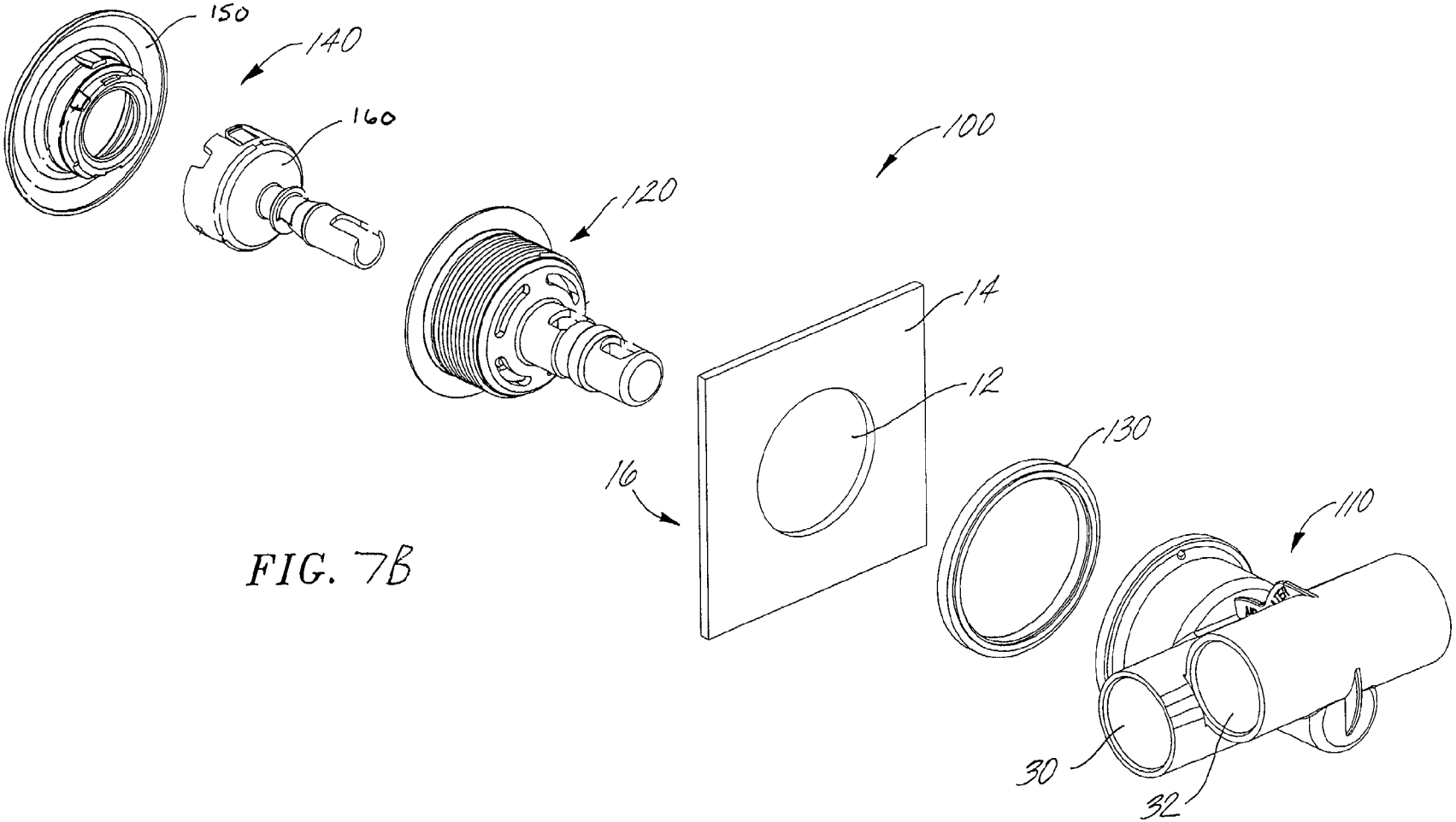

FIGS. 7A–B illustrate a spa jet mounting assembly 100, according to the present invention. Those skilled in the art will recognize that the present invention can be utilized with various spas, baths, tubs, therapy receptacles, and water receptacles. Moreover, those skilled in the art will recognize that the present invention can be used to mount spa jets into front, back, and side walls, and even the base or floor of the bath. Additionally, those skilled in the art will appreciate that the present invention can be utilized to retrofit spa jets into an existing bath, or to build spa jets into new baths. However, for simplicity, this specification illustrates the example of mounting spa jets into a side of a bath, but is not so limited.

The mounting assembly 100 includes an outer housing 110 located outside or behind the bath 10, an inner housing 120 which is inserted into the outer housing from inside the bath through opening 12, and one or more seals or gaskets 130 around the bath opening 12.

Outer Housing

Figure 8:
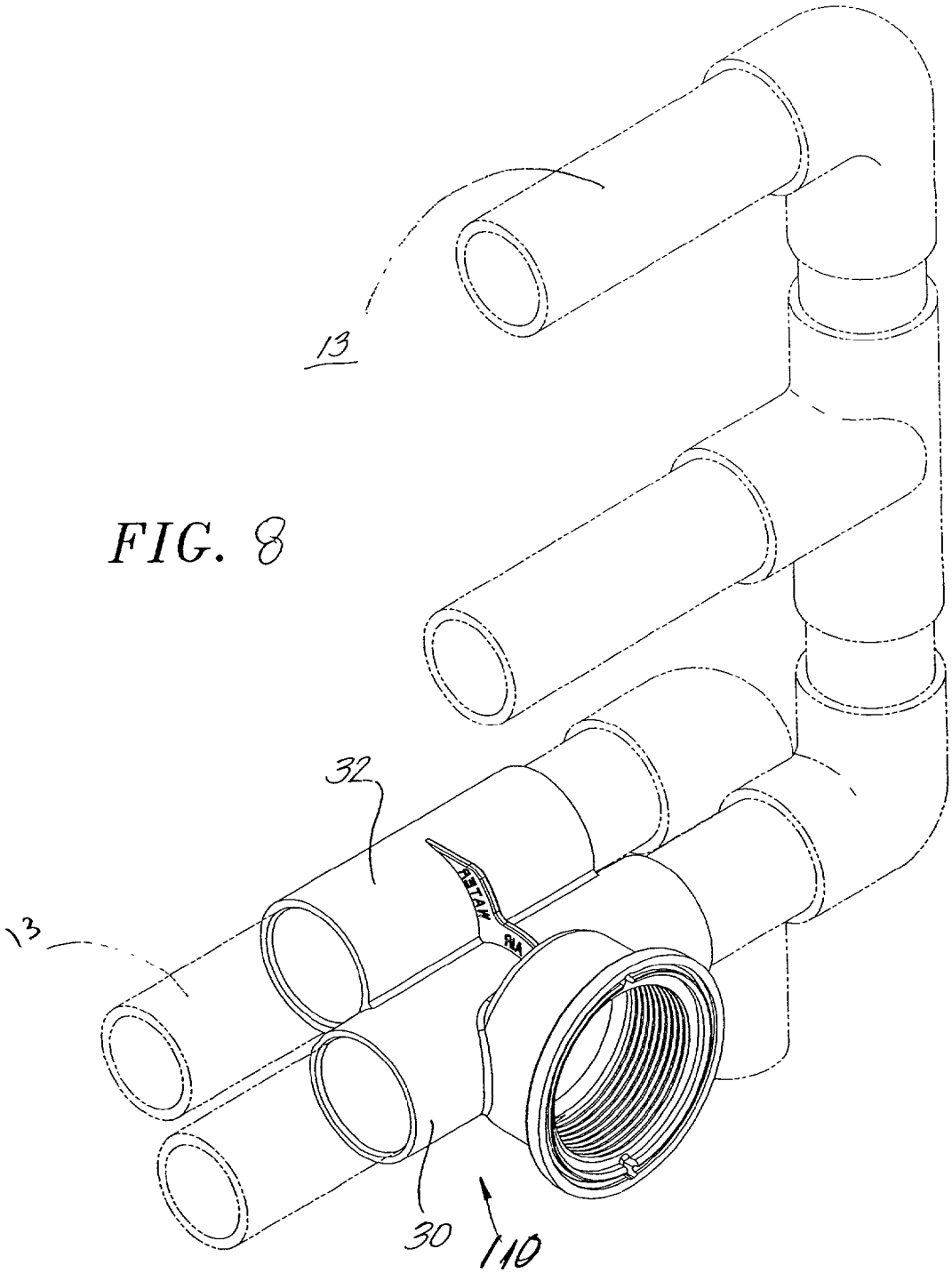
FIG. 8 is a perspective view of the housing of the spa jet mounting assembly coupled to air and water supply pipes.

Referring to FIG. 8, the outer housing 110 is fixedly connected to air and water pipes of a yoke 13 (phantom lines) through air and water couplers 30, 32. The yoke 13, air coupler 30 and water coupler 32 are all located outside the bath 10.

Figure 9A:
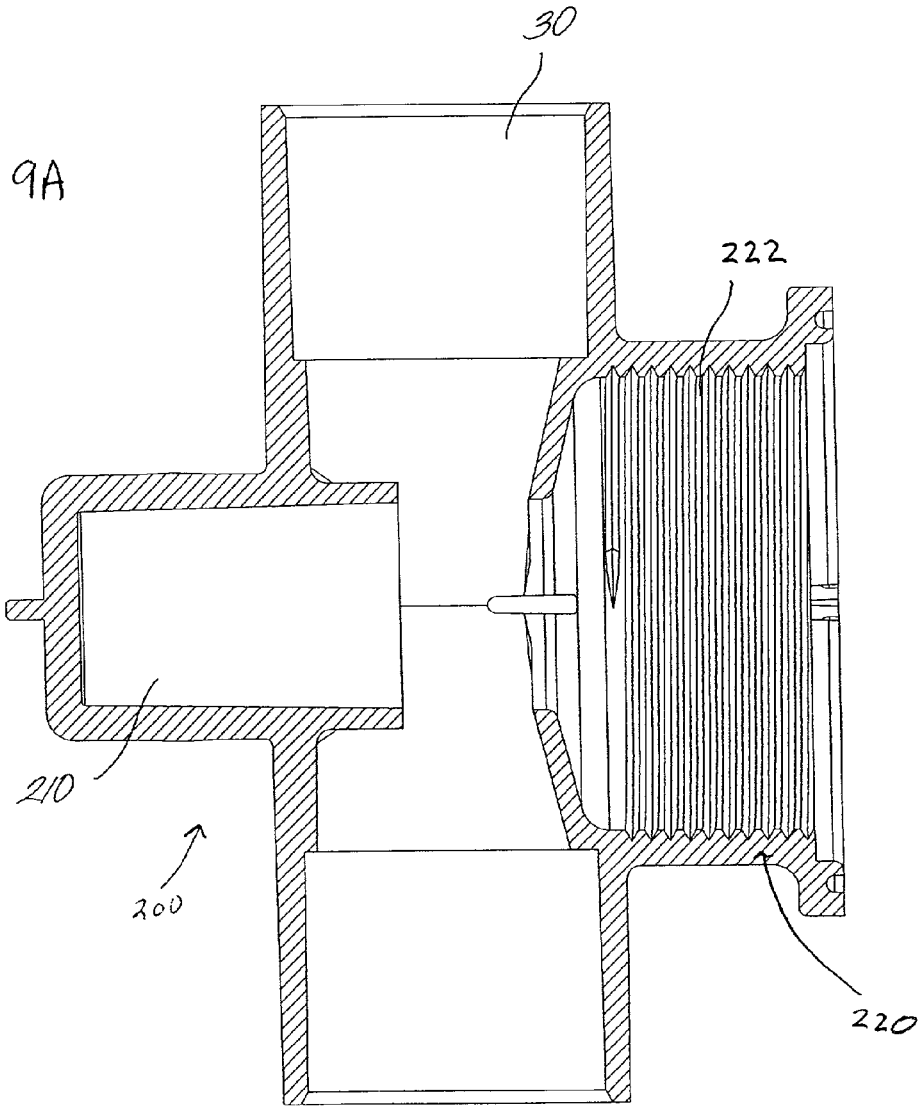
FIGS. 9A–B are top cross-sectional views of one piece and two piece outer housings, respectively.

Turning now to FIG. 9A, in one embodiment, the outer housing 110 comprises a single member 200 with a cylindrical inner chamber or housing 210 extending generally at right angles from the air and water pipes. Air and water inlet ports in the outer housing are in communication with the air and water pipes through air and water couplers 30, 32 and the cylindrical inner chamber 210.

For example, the air coupler 30 can be integrated into the chamber 210 through two ports in opposing sides of the chamber 210, and the water coupler 32 can be integrated into the chamber 210 through a port in the top or bottom of the chamber 210.

The single member outer housing 200 also includes a receiving chamber 220 with a threaded inner diameter 222, coaxial with the axis of the cylindrical inner chamber 210. The threaded inner chamber 222 is configured for coupling to the inner housing 120.

Figure 9B:
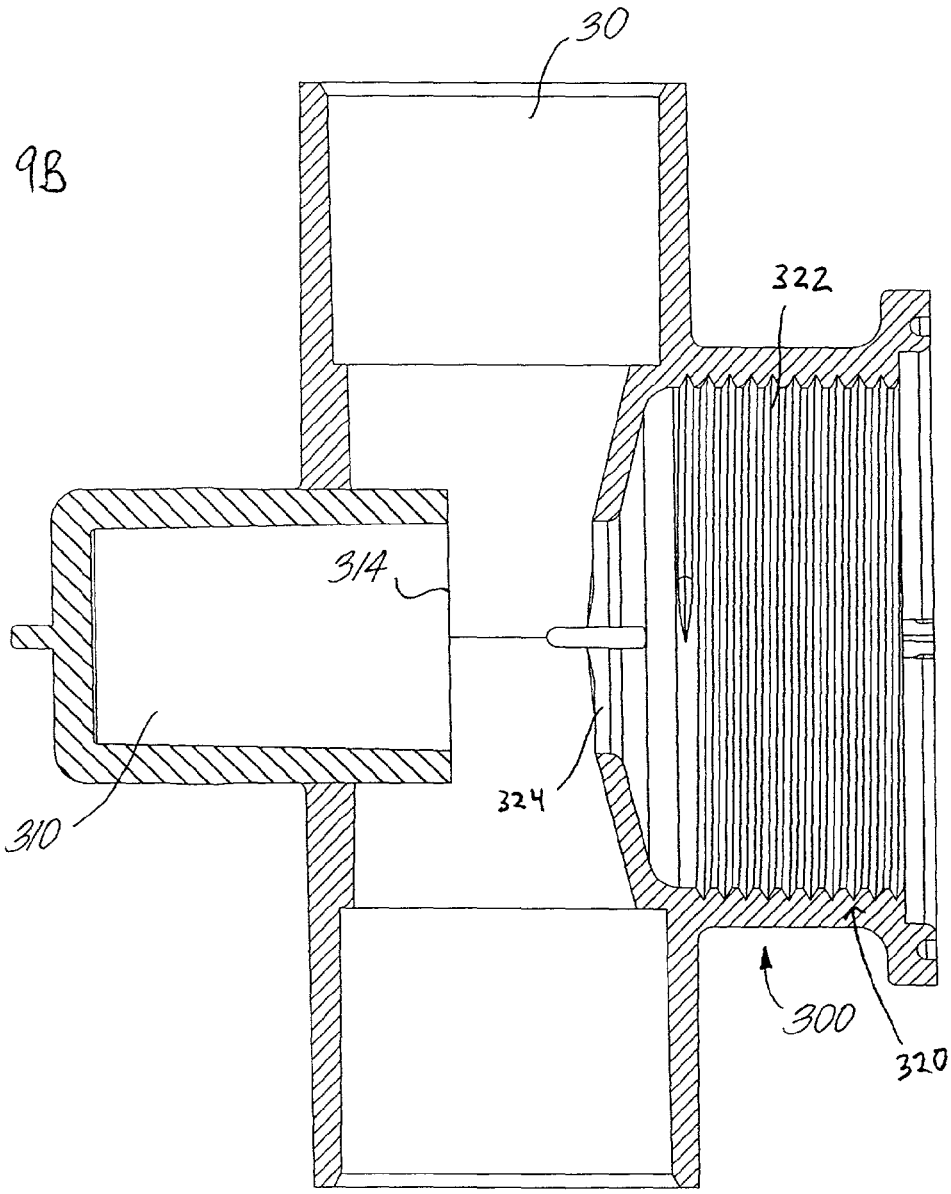

With reference to FIG. 9B, in an alternative embodiment, the outer housing comprises two separate members—a cylindrical inner chamber 310 and a receiving chamber 320. An open end 314 of the inner chamber 310 is coupled to an opposite port in the air coupler 30. Additionally, although not illustrated in FIG. 9B, the inner chamber 310 is ported to the water coupler 32. The receiving chamber 320 includes a threaded inner diameter 322, configured for coupling to the inner housing 120. The receiving chamber 320 also includes an open end 324 which couples to the air coupler 30. As a result, the receiving chamber 320 is in communication with the air coupler 30, and the inner member 310 serves as an interface between the spa jet and air and water couplers 30, 32.

Those skilled in the art will appreciate that either the one or two member outer housings 110 can be utilized and that the inner chambers 210, 310 can be designed with different ports for different air and water coupler 30, 32 configurations.

Figure 10:
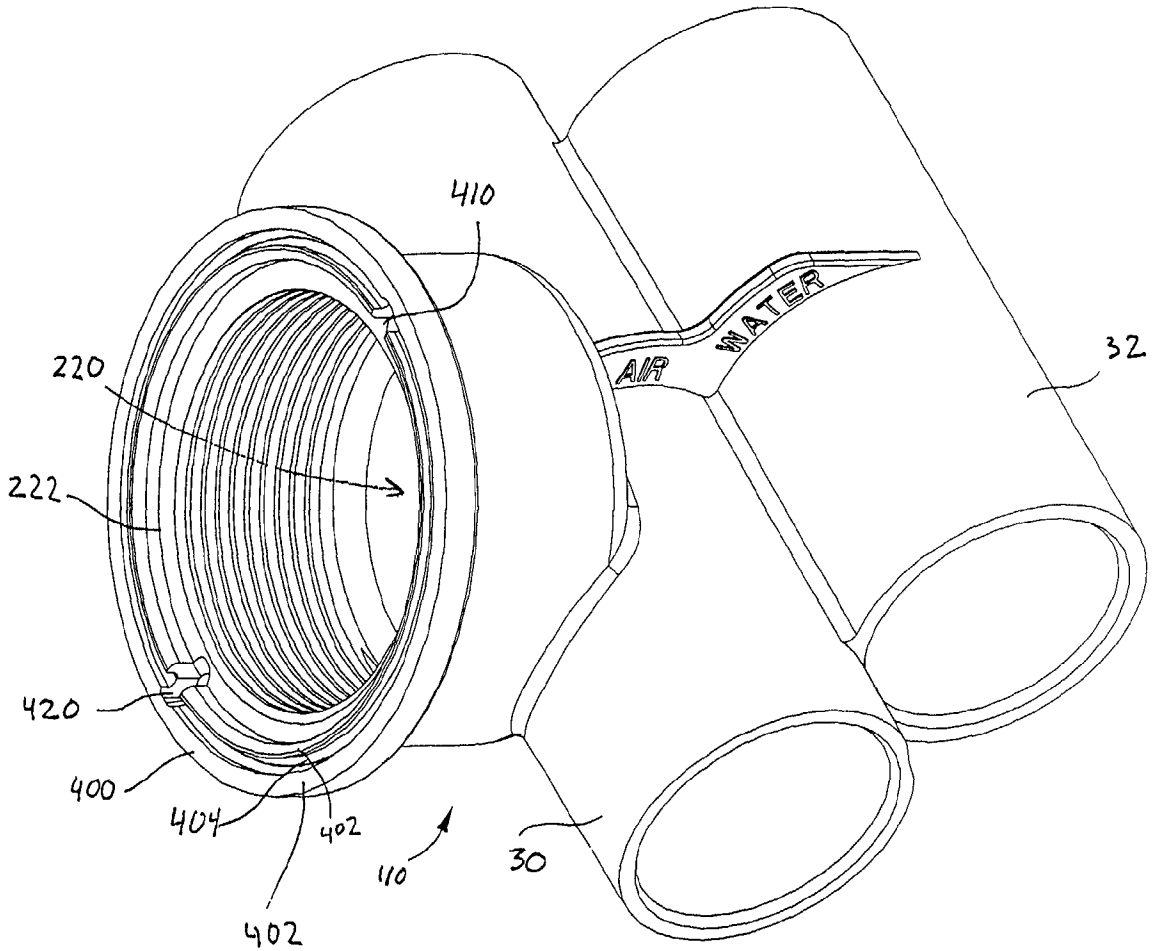
FIG. 10 is an exploded view of the outer housing.

Turning now to FIG. 10, the receiving chamber 220 of the outer housing includes a circular front face or mounting flange 400. The mounting flange 400 includes inner and outer, generally annular clamps 402 forming a groove 404. The clamps 402 and the groove 404 facilitate placement of a sealing ring or gasket 130. For example, a sealing ring with a corresponding ridge can be snapped into and secured into clamps 402 to seal the outer housing 110 to the outside bath surface 16 and prevent water leakage.

As illustrated, the clamps 402 are annular and are positioned around the entire mounting flange 400. However, those skilled in the art will appreciate that the clamps 402 can be secured to a portion of the flange, and that a sealing ring or gasket with a corresponding ridge can be placed in such clamps 402.

The receiving chamber 220 also includes inlet and outlet ports 410, 420 for use in forming a seal around the flange using an injection process.

Inner Housing

Figure 11A:
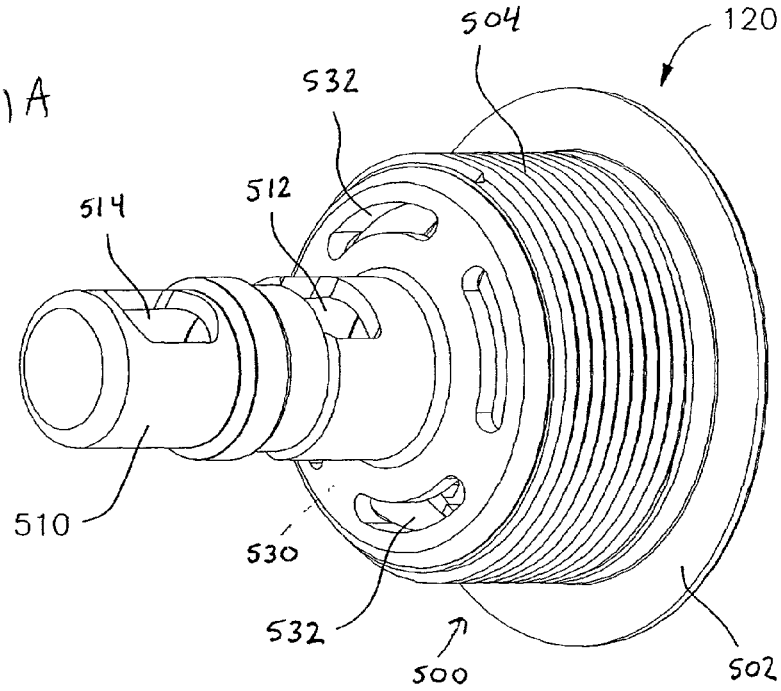
FIGS. 11A–B are perspective views of an inner housing.
Figure 11B:
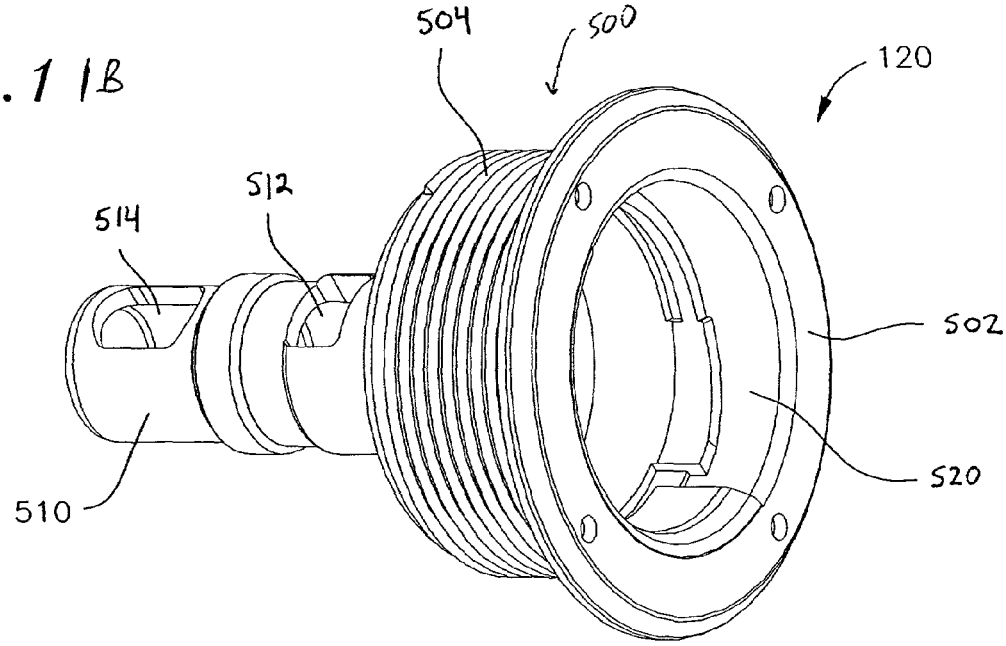

FIGS. 11A–B illustrate the inner housing 120 in further detail. The body of the inner housing 120 is inserted from inside the bath 10, through the passageway 12, and secured within the outer housing. More specifically, an exterior threaded region of the inner housing is threadedly or rotatably secured from inside the bath, to the threaded interior or receiving chamber of the outer housing 110.

The threaded interior of the receiving chamber extends a sufficient length to accommodate various thicknesses of bath walls or surfaces. Thus, for example, an inner housing will be threadedly secured through a small portion of the outer housing through a thick wall. In contrast, the inner housing will be threadedly secured through a larger portion of the outer housing through a thinner wall. As a result, the threaded sections of the inner and outer housing sections can accommodate various bath surface thicknesses.

The inner housing 120 includes an enlarged head 500 with a flange 502 and an external threaded cylindrical body 504. The inner housing 120 also includes a narrower cylindrical body 510 having separate ports 512, 514 for admission of air and water.

From the inside of the bath, the inner housing 120 is inserted through the opening 12 and threadedly connected to the threaded inner diameter 222 of the outer housing 110. A protective ring or gasket 130 can be placed between the flange 502 and the inside surface 14 of the bath to prevent water leakage. Moreover, those skilled in the art will appreciate that clamps and the resulting groove illustrated in FIG. 10 can also be utilized to secure a sealing ring between the flange 502 of the inner housing and the inside surface of the bath.

The cylindrical body 510 of the inner housing 120 is inserted through the receiving chamber 220 of the outer housing 110, and into the narrower inner chamber 210. As a result, the air and water ports within the outer housing 110 communicate with the separate air and water ports 512, 514 of the narrower cylindrical body of inner housing 120.

A spa jet 140 is snapped or locked into the inner housing 120 via locking threads 520. The cylindrical body 510 of the inner housing 120 receives a narrower cylindrical body of the spa jet 140. The separate air and water ports of the spa jet 140 are aligned, or partially aligned, with the separate ports 512, 514 of the cylindrical body 510.

As a result, air and water can be directed from the air and water pipes, through the couplers 30, 32 and ports in the outer housing 110, through the ports 512, 514 of the cylindrical body 510 of the inner housing 120, and into inlet air and water ports of the spa jet. The spa jet then produces an aerated stream of water.

Seal

As previously described, the outer housing 110 and/or inner housing 120 can be sealed against their respective bath surfaces 14, 16 with a protective ring or seal 130, e.g., an elastomeric seal.

For example, either of the flanges of the inner and outer housings can include annular clamps forming a groove, which are secured to the bodies of the inner and outer housing bodies. The clamps engage opposite sides of the wall around the opening of the bath. A seal 130 with a ridge corresponding to the width and size of the groove in the mounting flange of the inner and/or outer housing can be snapped and secured into the groove. Alternatively, the ridge can be a single bump that is snapped into a part of the groove. In both configurations, the protective ring can be effectively secured to the flange of the receiving chamber, reducing or eliminating manual adjustment and alignment of the gasket. Thus, the elastomeric seal is compressed between a clamp of one or more of the housings and the respective surface of the bath.

The elastomeric seal is sufficiently flexible such that when it is compressed, it conforms to the shape of the bath surface. Thus, if the bath surface has curved, warped, or non-planar surfaces, the elastomeric seal can be compressed against such surfaces to eliminate or fill in surface irregularities. As a result, the elastomeric seal eliminates or reduces misalignment of the spa jet and spa jet components through the opening in the bath with irregular surfaces. For example, the elastomeric gasket can be compressed such that it fills in irregularities of 2–5 degrees relative to a flat or planar bath surface. Of course, those skilled in the art will recognize that a regular o-ring can also be utilized.

A second seal can be formed using an injection process. For example, FIG. 10 illustrates inlet and outlet ports 410, 420 in the outer housing 110. The inlet and outlet ports 410, 420 are positioned on opposite sides of the mounting flange 400 of the outer housing 110.

A sealant, e.g., silicone, which is initially in a liquid state, is injected into the inlet port 410. Air that is displaced as a result of the silicone injection is released through the outlet port 420.

As the silicone is injected, it flows along and is guided by the elastomeric ring. Using the elastomeric ring reduces the amount of liquid silicone that would fall from the injection path since the silicone can partially adhere to the elastomeric ring. As the silicone fills the groove formed by the clamps, it encapsulates the threaded interior of the outer housing, fills the space between the flange 400 and outside 16 of the bath 10, as well as space between the outer flange of the inner housing and the inside surface of the bath. Eventually, the liquid sealant sets, thereby forming a complete second seal 130 around the passageway 12 in the bath. The elastomeric ring and the second, injected seal can form a single seal around a flange, forming a more secure and effective seal.

Drain Ports

Referring again to FIG. 11A, in one embodiment, a base 530 of the inner housing's threaded portion 504 includes four drainage ports 532. The drainage ports 532 are curved or rounded, extending around the perimeter of the base 530 of the inner housing 120. Of course, other drainage port 532 designs can be implemented.

The example drainage system increases the drainage capabilities of mounting assemblies. For example, conventional drainage systems with a single drainage port can achieve drain rates up to about 93%. The drainage ports 530 in the inner housing 120 of the present invention can achieve drain rates up to about 98%, thereby reducing the amount of stagnant water in the assembly and the risk of bacteria growth and other health hazards.

Spa Jet Mounted in Assembly

Figure 12:
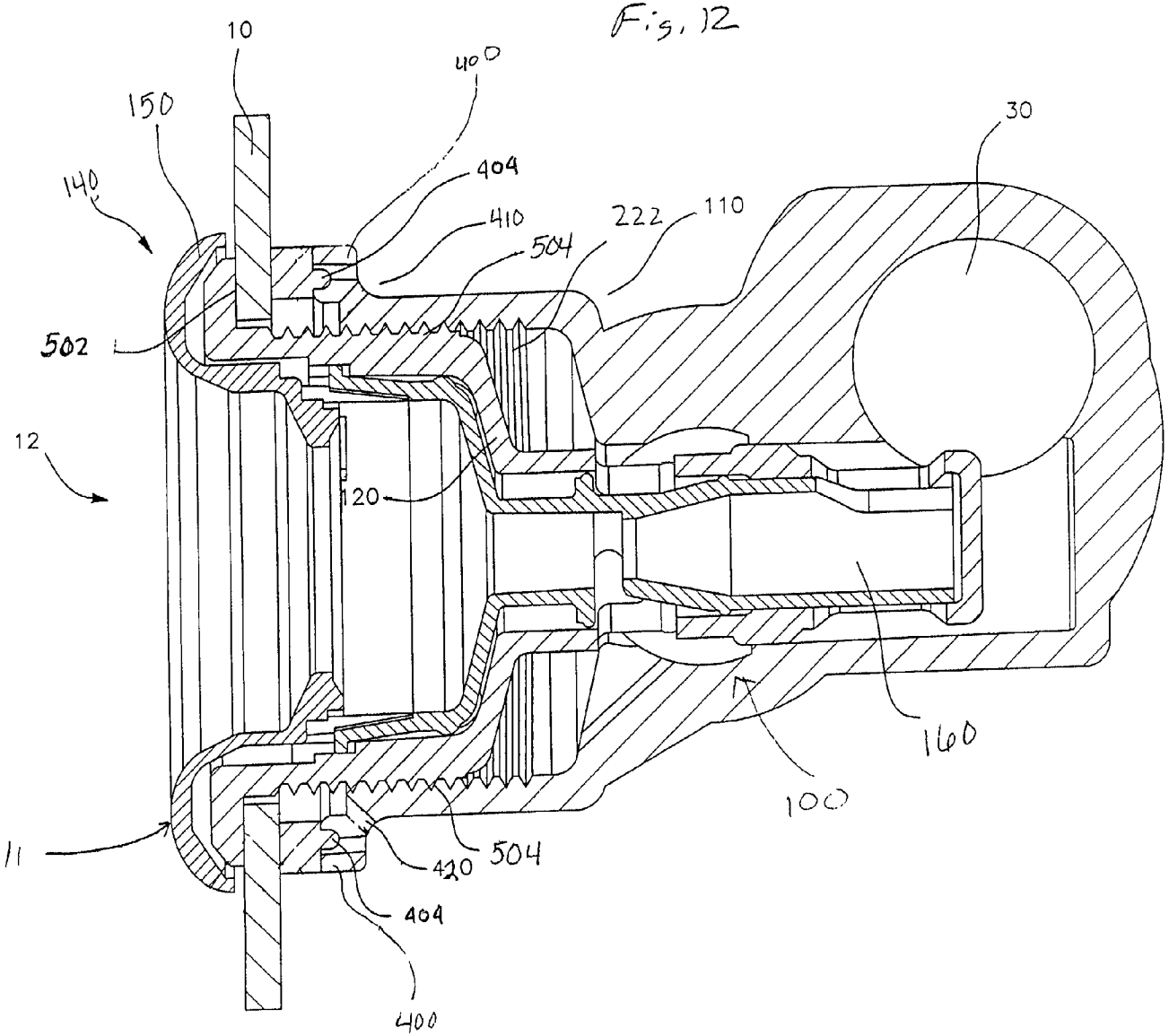
FIG. 12 is a cross-sectional view of a spa jet installed within the mounting assembly according to the present invention.

Turning now to FIG. 12, a spa jet 140 is illustrated as secured within the mounting assembly 100 of the present invention. A spa jet 140 (with cap 150 and body 160 sections) is secured within an inner housing 120 which is inserted through a passageway 12 from the inside of the bath, and threadedly secured into the outer housing 110 via threaded sections 202, 502.

A spa jet 140 is inserted from inside the bath 10, and locked into the inner housing 120. The spa jet body 160 has a generally tubular body with an enlarged head at its inner end which mounts to a rotating jet nozzle. The narrower cylindrical body has separate ports for admission of air and water into the spa jet to mix and emerge as an aerated stream through a nozzle. The spa jet 140 also has locking portions which enable it to lock into an appropriate configured seat or locking threads 520 of the inner housing 120 with a push and turn movement. The mounting assembly enables the spa jet to be connected to a system of parallel connected air and water pipes extending outside the bath.

One example spa jet with this design is described in U.S. Pat. No. 6,322,004('004 patent) manufactured by Pentair Pool Products, Inc., Moorpark, Calif. The spa jet 140 can be rotated while being retained by the locking threads 520. As a result, the amount of air and water entering the spa jet 140 can be adjusted by rotation of the spa jet body 160 and air and water ports within the boundaries of the locking threads 520. As a result, the force of the aerated water stream upon a bather's anatomy can be rotatably adjusted.

To remove the spa jet 140 from the inner housing 120, the spa jet 140 is twisted or rotatably released from the locking threads 520 of the inner housing 120.

Of course, those skilled in the art will appreciate that various techniques and mechanisms can be utilized to lock and release a spa jet 140 with inner housing 120. Thus, the example locking threads 520 of the inner housing 120 are merely illustrative of many spa jet 140 mounting options.

The tubular body 510 of the inner housing 120 can be inserted through the receiving chamber 220 of the outer housing 120, and into the cylindrical inner chamber 210 of the outer house. The narrower, cylindrical body 160 of the spa jet is received within the cylindrical chamber 210 of the inner housing 120. A flange 500 of the inner housing 120 is flush against the inside 16 of the bath 10. A silicone ring 130, formed by the injection process utilizing inlet and output ports 420 seals the opening 12 between the outside 14 of the bath and the mounting flange 400 of the outer housing 120.

Indeed, those skilled in the art will recognize that many different types of spa jets 140 can be inserted into an inner housing 120, and that the mounting assembly 100 has broad applications to installing and mounting different spa jets into different bathing and therapy receptacles.

Method of Installation and Operation

Based on the forgoing description of a spa jet mounting assembly, a spa jet can be installed and utilized in a bath can be summarized as follows.

Initially, an opening is formed in a wall or surface of the bath. The outer housing body is connected to air and water pipes through air and water couplers. The outer hosing is connected to air and water pipes through the air and water couplers. The air and water pipes and outer housing are positioned around the bath. The outer housing is aligned with a corresponding opening formed in the wall of the bath. A seal ring is placed between at least one of the flanges and the bath wall around the opening.

In order to form a seal, clamps in a housing forming a groove extending around a face of the flange can be used to secure a sealing ring with a corresponding ridge. The elastomeric ring can be snapped into or secured within the clamps by inserting said ridge into said groove.

Additionally, a second seal can be formed utilizing the inlet and outlet ports. With the injection technique, a liquid sealant, such as silicone, is injected into the inlet port. Air that is displaced as a result of the silicone injection is released through the outlet port of the flange. The sealant eventually sets into an elastomeric state, forming the second seal around the flange and around the opening in the bath.

With this technique, the injected seal can be formed around the first, elastomeric seal. As a result, a single seal can be formed between the annular flange and the wall of the bath.

The inner housing is threadedly secured within the internally threaded chamber of the outer housing through the opening in the wall, thereby tightening the mounting flange of the outer housing against the sealing ring. As a result, the sealing and injected rings are compressed against the bath wall.

The inner housing can be tightened such that the air and water inlet ports in the inner and outer housings are aligned, for communication with the air and water pipes.

A spa jet is then inserted and locked into the cylindrical body of the inner housing. In order to lock the spa jet, the spa jet is pushed into a locking position and turned, thereby locking the spa jet into said inner housing through the locking surfaces of the spa jet engaging said locking surfaces of said inner housing. As a result, the air and water inlet ports of the spa jet body partially or completely coincide with the air and water ports of the inner housing, which are in communication with the air and water pipes through the air and water couplers and the ports in the outer housing.

Upon installation, air and water are directed from the air and water pipes, into the air and water couplers, into the air and water ports of the outer housing, into the air and water inlet ports of the inner housing, and into the air and water inlet ports of the spa jet. The spa jet produces an aerated water stream.

The spa jet body can be adjusted by rotating the body within locking boundaries of the locking surfaces of the head of the inner housing and the locking surfaces of the spa jet. As a result, the amount of air and water entering the spa jet is adjusted, thereby adjusting the force of the aerated water stream.

During and after use of the spa jet, water can be drained through one or more drain ports in a base of the threaded chamber of the inner housing. The one or more drain ports extend around a perimeter of the base of the threaded chamber.

When finished with the spa jet or when repairs are necessary, the spa jet can be removed from the assembly by turning the spa jet beyond the locking boundaries. As a result, the locking surfaces of the spa jet are released from the locking surfaces the inner housing.

Although references have been made in the foregoing description to a preferred embodiment, persons of ordinary skill in the art of designing spa jets and spa jet mounting assemblies will recognize that insubstantial modifications, alterations, and substitutions can be made to the preferred embodiment described without departing from the invention as claimed in the accompanying claims. Thus, while the preferred embodiment is described as utilizing a housing and adapter with circular shapes and complementary threaded connections, those skilled in the art will recognize that other shapes and connections can be utilized. For example, instead of threaded connections, snapping or locking connections can be utilized. Thus, for example, the adapter can be inserted into the receiving portion of the housing until a piece of the adapter locks into gap or groove in the housing. Snapping or locking mechanisms.

What is claimed is:

1. An assembly for mounting a spa jet through an opening in a wall of a bath and for connecting the spa jet to water and air pipes located outside the bath, the spa jet having air and water inlet ports which receive and mix air and water and to cause the spa jet to emit at least one jet of aerated water, the assembly comprising:

an outer housing located outside the bath, said outer housing fixedly connected to the water pipe and the air pipe, said outer housing having an outer housing body configured to receive air from the air pipe through an air port in said outer housing body, and to receive water from the water pipe through a water port in said outer housing body;

an inner housing including an inner housing body, said inner housing body extending through the opening in the bath and into said outer housing body, said inner housing body including an air inlet port for receiving air from the air pipe through said air port of said outer housing body, and a water inlet port for receiving water from the water pipe through said water port of said outer housing body, wherein air is provided from the air pipe through said air port of said outer housing body to said air inlet port of said inner housing body, wherein water is provided from the water pipe through said water port of said outer housing body to said water inlet port of said inner housing body; and inner and outer, generally annular clamps, secured to said bodies of said inner and outer housings, said clamps engaging opposite sides of the wall around the opening;

said inner housing configured to receive and secure the spa jet therein and to provide air and water to air and water inlets of the spa jet, thereby causing the spa jet to emit the jet of aerated water into the bath.

2. The assembly of claim 1, wherein said outer housing includes a cylindrical receiving chamber and said inner housing includes an external threaded region, said inner housing body being threadedly engaged within said receiving chamber.

3. The assembly of claim 1, wherein said inner housing is rotatably securable within said outer housing.

4. The assembly of claim 3, wherein said inner housing is rotatably securable from inside the bath.

5. The assembly of claim 1, wherein said inner housing includes one or more drain ports extending around a base of said inner housing, said one or more drain ports configured to drain water from the mounting assembly.

6. The assembly of claim 1, further comprising an elastomeric seal positioned and compressed between said clamp of said outer housing and the outside of the bath, said seal surrounding the opening in the bath.

7. The assembly of claim 6, said clamp of said outer housing having a groove formed therein, wherein said elastomeric seal is secured within said groove of said clamp.

8. The assembly of claim 6, said outer housing having:

an annular flange with an inlet port and an outlet port, said flange extending around the opening in the bath; and a sealant which is initially in a liquid state and sets into an elastomeric body, wherein a second seal is formed between said flange and the outside of the bath by injecting said sealant in its liquid state into said inlet port of said flange, releasing displaced air through said outlet port of said flange, and allowing said sealant to set into its elastomeric state, thereby forming said second seal around the opening in the bath.

9. The assembly of claim 8, wherein said sealant is silicone.

10. The assembly of claim 8, wherein said liquid sealant is guided by said elastomeric seal around said annular flange, thereby forming said second seal.

11. The assembly of claim 10, wherein said elastomeric seal and said second injected seal form a single seal around the opening in the bath.

12. An assembly for mounting a spa jet through a mounting opening in a wall of a bath, the spa jet having a generally tubular body with an enlarged head at its inner end which mounts to a rotating jet nozzle and a relatively narrower cylindrical body having separate ports for admission of air and water into the spa jet to mix and emerge as an aerated stream through the nozzle, the spa jet also having locking portions which enable it to lock into position with a push and turn movement, the assembly enabling the spa jet to be connected to a system of connected air and water pipes extending outside the bath and spaced generally in relation to the bath wall, the assembly comprising:

an outer housing fixedly connected to the air and water pipes, said outer housing having an outer housing body with air and water ports, a cylindrical inner chamber in said body extending generally at right angles from the pipes, said ports in said body communicating with the air and water pipes and said chamber;

an internally threaded receiving chamber in said body coaxial with said inner chamber; and an annular outer flange extending around said threaded receiving chamber and sized to surround the opening in the bath;

an inner housing including, an annular, enlarged end having an externally threaded region, said enlarged end being configured for receiving the head of the spa jet therein, said externally threaded region of said inner housing threadedly engaging said threaded internal receiving chamber of said outer housing, an annular inner flange connected to and extending around said enlarged end which engages an interior surface of the bath wall; said inner flange clamping an opposite side of the bath wall by threadedly securing said externally threaded region of said inner housing and said threaded internal receiving chamber of said outer housing;

a cylindrical valving portion extending from said enlarged end concentrically into said cylindrical inner chamber of said outer housing, having separate air and water inlet ports which communicate with said air and water ports in said outer housing to direct air and water into said inner housing; and locking surfaces within said annular, enlarged end of said inner housing which engage the locking portions of the spa jet when the spa jet is pushed into position and turned, thereby locking the spa jet in said inner housing; said air and water inlet ports in said valving portion positioned to deliver air and water into the air and water ports of the spa jet; and a seal positioned between at least one of said flanges and the bath wall, said seal surrounding the opening thereby preventing leaking of water through the opening in the bath and around said housings.

13. The mounting assembly of claim 12, wherein said inner housing is rotatable to adjust an amount of air and water delivered from said air and water ports of said valving portion into the air and water ports of the spa jet.

14. The assembly of claim 12, wherein a base of said enlarged end of said inner housing includes a plurality of drain ports extending around a base of said enlarged end for draining water from the mounting assembly.

15. The mounting assembly of claim 12, wherein said seal concentrically aligned with said mounting flange comprises an elastomeric o-ring.

16. The assembly of claim 15, said annular outer flange having a clamp formed by a groove extending around a face of said outer flange, said elastomeric seal having a ridge shaped corresponding to said groove, wherein said elastomeric seal is secured within said clamp by inserting said ridge into said groove.

17. The mounting assembly of claim 15, the assembly further comprising a second seal, said second seal being formed with a sealant which is initially in a liquid state and sets into an elastomeric body, wherein said mounting flange includes an inlet port and an outlet port, and said second seal is formed between said flange and the outside of the bath by injecting said sealant in its liquid state into said inlet port of said flange, releasing displaced air through said outlet port of said flange, and allowing said sealant to set into its elastomeric state, thereby forming said second seal around the opening in the bath.

18. The assembly of claim 17, wherein said sealant is silicone.

19. The assembly of claim 17, wherein said liquid sealant is guided by said elastomeric seal around said annular flange, thereby forming said second seal.

20. The assembly of claim 17, wherein said elastomeric seal and said second injected seal form a single seal around the opening in the bath.

* * * * *